US006680668B2

(12) United States Patent
Gerber et al.

(10) Patent No.: US 6,680,668 B2
(45) Date of Patent: Jan. 20, 2004

(54) FAST HEAT RISE RESISTOR USING RESISTIVE FOIL

(75) Inventors: George V. Gerber, Bonita, CA (US); Anthony E. Troianello, Santa Ana, CA (US); Haim Goldberger, Holon (IL)

(73) Assignee: Vishay Intertechnology, Inc., Malvern, PA (US)

( * ) Notice: Subject to any disclaimer, the term of this patent is extended or adjusted under 35 U.S.C. 154(b) by 0 days.

(21) Appl. No.: 09/765,901

(22) Filed: Jan. 19, 2001

(65) Prior Publication Data

US 2002/0097137 A1 Jul. 25, 2002

(51) Int. Cl.[7] ..... H01C 1/012
(52) U.S. Cl. ..... 338/307; 338/307
(58) Field of Search ..... 338/306, 307, 338/308, 309

(56) References Cited

U.S. PATENT DOCUMENTS 3,974,424 A * 8/1976 Lee ..... 361/248
4,317,104 A * 2/1982 Bergmann et al. ..... 338/330
4,511,877 A * 4/1985 Nishikawa et al. ..... 338/2
4,944,225 A 7/1990 Barker
4,976,200 A 12/1990 Benson et al.
5,080,016 A 1/1992 Osher
5,214,407 A * 5/1993 McKim, Jr. et al. ..... 338/49
5,218,334 A * 6/1993 Bartlett ..... 338/61
5,223,820 A * 6/1993 Sutterlin et al. ..... 340/641
5,604,477 A * 2/1997 Rainer et al. ..... 338/293
5,770,993 A * 6/1998 Miyazawa et al. ..... 337/160
6,159,386 A * 12/2000 Wienand et al. ..... 216/16
6,181,234 B1 * 1/2001 Szwarc et al. ..... 338/53
6,232,042 B1 5/2001 Dunn et al.
6,343,000 B1 * 1/2002 Yokoyama et al. ..... 361/247
6,385,031 B1 * 5/2002 Lerche et al. ..... 361/248

* cited by examiner

*Primary Examiner*—Karl D. Easthom
(74) *Attorney, Agent, or Firm*—McKee, Voorhees & Sease, P.L.C.

(57) ABSTRACT

A fast heat rise resistor comprising a substrate, a foil bridge on the surface of the substrate, the foil bridge having an elevated portion and a contact portion, the elevated portion above the substrate, the contact portion in contact with the substrate, a conductive layer attached to the contact portion of said foil bridge. The activation energy and/or response time is reduced as the foil bridge is suspended over the substrate. Another aspect of the invention include a method of manufacturing the foil bridge and application to autoignition vehicle airbags.

7 Claims, 3 Drawing Sheets

FAST HEAT RISE RESISTOR USING RESISTIVE FOIL

BACKGROUND OF THE INVENTION

A. Field of the Invention

This invention relates to a method and apparatus for a fast heat rise resistor that can be used as a resistive igniter. More particularly, this invention relates to the use of resistive foil and photolithographic production to produce a fast heat rise resistor, the resistor suitable for use as an igniter in autoignition-deployed safety devices.

B. Problems in the Art

There are numerous needs for fast heat rise resistors. One such need relates to the use of a resistor as an igniter used to ignite a pyrotechnic or other explosive material. In these resistive igniter applications, it is desirable that the resistive igniter act quickly for rapid ignition. One such application is in vehicle airbag inflators where it is crucial that an igniter act quickly to ignite a gas-generating pyrotechnic in order to ensure that an air bag is deployed in a timely fashion. As the resistor is driven by current, the heat of the resistor increases to a point where other material such as pyrotechnic material can be ignited. There are numerous other applications of resistive igniters, including in other auto-ignition devices such as seatbelt pretensioners, battery cable disconnects, fuel line shut off devices, roll bars, safety devices, and other applications.

There have been attempts made at a resistive igniter in the prior art. Previous attempts have been made that have used metal wire or film bridges. In metal wire or bridgewire devices, a metal filament also known as a bridgewire is used. Some problems with bridgewire devices involve the difficulties involved in manufacturing bridgewires. In order to predict performance of a bridgewire, there must be uniform thermal and electrical properties. Problems remain in manufacturing bridgewires of the needed uniformity.

Another problem with bridgewire devices is that the response time is too slow or else too much activation energy is required. This is problematic where a fast response time is needed or else there are limited power resources that can not support large activation energies. One example of a situation where there are limited power resources is in a vehicle where a 12 volt battery is used to activate an igniter.

Yet another problem with bridgewire devices involves reliability. In bridgewire devices pyrotechnic powder is pressed against the bridgewire. This process can result in detachment of the bridgewire. Thus there are reliability problems with bridgewires as well.

Other attempts at creating resistive igniters have used metal film bridges that are either thin film or thick film. One problem with a thick film or thin film approach is the increased cost of manufacturing associated with these approaches, and in particular with the thin film approach. Another problem with a metal film approach is that there is contact between the metal film bridge and a substrate. This contact between the metal film bridge and the substrate results in a loss of heat from the metal film bridge to the substrate, resulting in an increase in the amount of time for the metal film bridge to reach a particular temperature or alternatively, an increase in the amount of current required in order for the metal film bridge to reach a particular temperature in a given time.

Another problem with film bridges relates to their reliability. Pyrotechnic powder is pressed against the bridge, however, this powder may become displaced during handling. Thus, the pressed powder may or may not constantly touch the wire or film. Where a liquid pyrotechnic is used, the same contact problems may also arise, as the liquid pyrotechnic may not be in constant contact with the wire or film. These problems result in an igniter that is not reliable.

Thus there is a need for a reliable heat rise resistor which has fast response and can be manufactured in a uniform fashion. There is a further need for a heat rise resistor that can be easily packaged and delivered to customers.

Thus, it is a primary object of the present invention to provide an igniter which improves upon the state of the art.

Yet another object of the present invention is to provide an igniter with a fast response time.

Another object of the invention is to provide an igniter that is reliable.

It is another object of the present invention to provide an igniter that requires decreased activation energy.

Yet another object of the present invention is to provide an igniter that can be manufactured uniformly.

Another object of the present invention is to provide an igniter suitable for use in auto-ignition safety devices.

A still further object of the present invention is to provide an igniter suitable for use in an airbag deployment system.

Yet another object of the present invention is to provide a fast heat rise resistor that does not lose heat to a substrate.

It is another object of the present invention to provide a fast heat rise resistor and method of making a fast heat rise resistor that can be easily packaged and distributed.

A still further object of the present invention is to provide a resistor capable of having all of its sides in contact with a pyrotechnic.

These and other objectives, features, or advantages of the present invention will become apparent from the specification and claims.

SUMMARY OF THE INVENTION

This invention describes a method and apparatus for a fast heat rise resistor using resistive foil with photolithographic production. The invention provides for a fast heat rise resistor that results in a fast response and is suitable for use as an igniter to ignite pyrotechnic material.

DESCRIPTION OF THE PREFERRED EMBODIMENT

Figure 1:
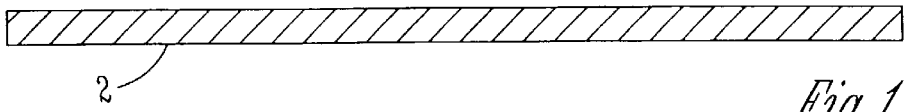
FIG. 1 is a cross-sectional diagram of the substrate of the resistor.

With reference to the drawings, the same reference numerals or letters will indicate the same parts or locations throughout the drawings unless otherwise indicated.

Method of The Invention

The steps of creating a fast heat rise resistor according to the present invention are shown in detail in the drawings. FIG. 1 shows a substrate 2. The substrate may be a polyimide substrate or other substrate such as are well known in the art. The layer of polyimide has a thickness of approximately two mil. The polyimide is preferably fully cured and surface etched. The present invention contemplates that the layer of polyimide may be a sheet of convenient size such as one that is 4 inches by 5 inches, or other standard or convenient size.

Figure 2:
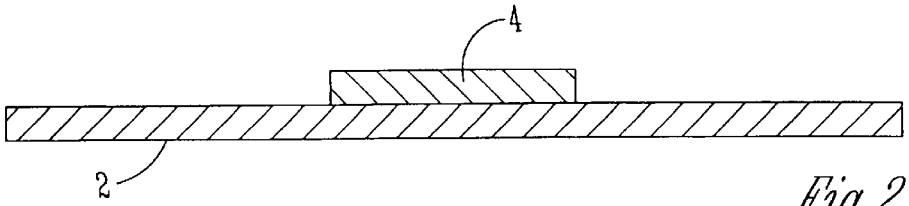
FIG. 2 is a cross-sectional diagram depicting the substrate with KAPTON® (Polyimide) layered on top.

In the next step, as best shown in FIG. 2, a layer of material such as KAPTON® (Polyimide) 4, is bonded or otherwise attached to the substrate 2. The present invention is not limited to KAPTON® (Polyimide) and contemplates that other types of material such as photoresistive film may be used in place of KAPTON® (Polyimide).

A photoresistive step is then applied to print a pattern on the KAPTON® (Polyimide) and to then develop the KAPTON® (Polyimide) so as to leave a series of stripes of KAPTON® (Polyimide) on the polyimide. The present invention contemplates that stripes of different dimensions may be used. The present invention further contemplates that film can be bonded in stripes as well such that the photoresistive step is not required, even though the photoresistive print and develop step provides a. convenient method of obtaining the KAPTON® (Polyimide) stripes. Stripes of 20 mils can be placed every 60 mils across the long dimension of the polyimide. It is to be appreciated that other configurations and dimensions of stripes can be used and the present invention contemplates these and other variations.

Figure 3:
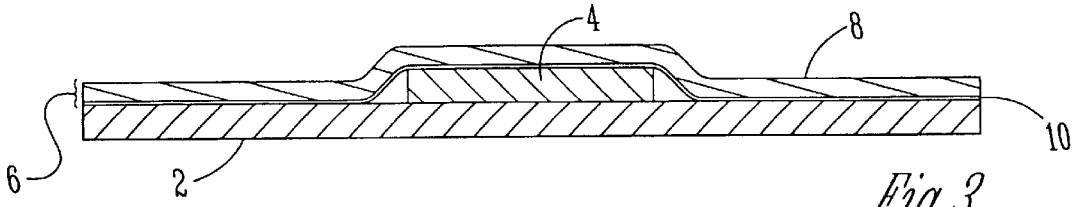
FIG. 3 is a cross-sectional diagram showing a substrate, KAPTON® (Polyimide) layer, and copper-plated foil.

As shown in FIG. 3, copper plated foil 6 is applied over the layer of KAPTON® (Polyimide) 4 and the substrate 2. The copper plated foil has a copper side 8 and a foil side 10. The foil used may be a Ni/Cr foil or other foil as may be known in the art. The copper plating is of a thickness of 1 mil, or of other thickness as required by the particular application of the resistor. The foil is of a thickness of 0.1 mil. The present invention contemplates other thicknesses of foil and copper plating. The selection of the foil material and of the thickness of the foil should be made so as to reflect the properties desired in the resulting resistor including the activation time and activation energy required. These requirements will be discussed later in the context of an exemplary embodiment of the fast heat rise resistor apparatus.

Figure 4:
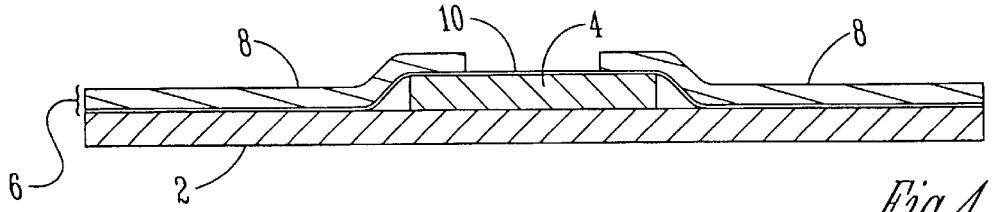
FIG. 4 is a cross-sectional diagram showing the resistor after the copper-plated foil has been preferentially dissolved away.

A first etching step is then applied to the resistor of FIG. 3. Through a Kodak® photo resistive process (KPR) or other photolithography process, a defined length of foil is printed on the copper side 8 of copper plated foil 6. The printing on copper plated foil 6 defines a length of the resistors in the array. The length of the resistor path may be 20 mils at this point, although the present invention contemplates other variations. After this printing and developing, the copper is ten preferentially etched away, leaving the portion desired. The resistor after the etching step is applied is best shown in FIG. 4. As FIG. 4 shows, the foil 10 is now exposed as the layer of copper on the foil 8 has been preferentially etched away.

Figure 5:
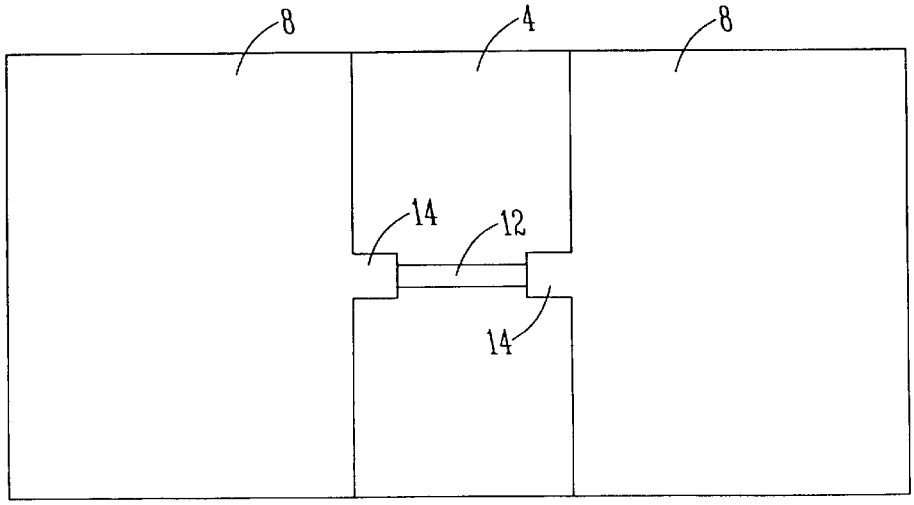
FIG. 5 is a top view depiction of the resistor after excess foil has been dissolved away.
Figure 6:
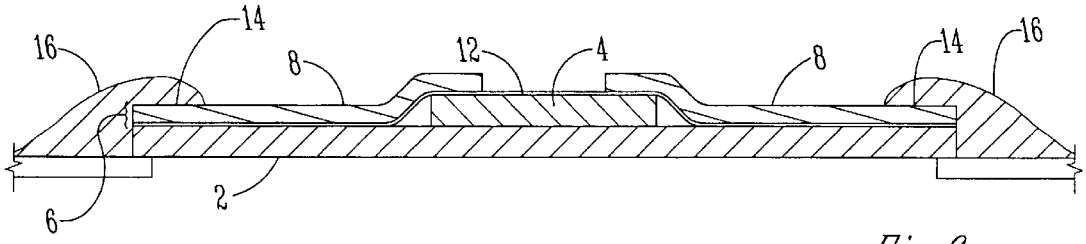
FIG. 6 is a cross-sectional diagram after the excess foil has been dissolved away.

A second print and etching step is then applied. In this step, the foil 10 is printed on to expose a defined width of the resistor trays. The present invention contemplates various widths of the traces but 1 mu is preferable. The high resistivity of foil 10 increases the amount of heat generated when current is passed through trace 10. The heat generated further increases as the width of foil 10 is reduced. The resulting resistor is shown in FIG. 5. As shown in FIG. 5. the foil trace 12 is now suspended between the copper terminals 14. FIG. 6 shows a perspective view of the resistor after this step has been completed. The resistive trace 12 of did foil remains suspended above KAPTON® (Polyimide) 4.

Figure 9:
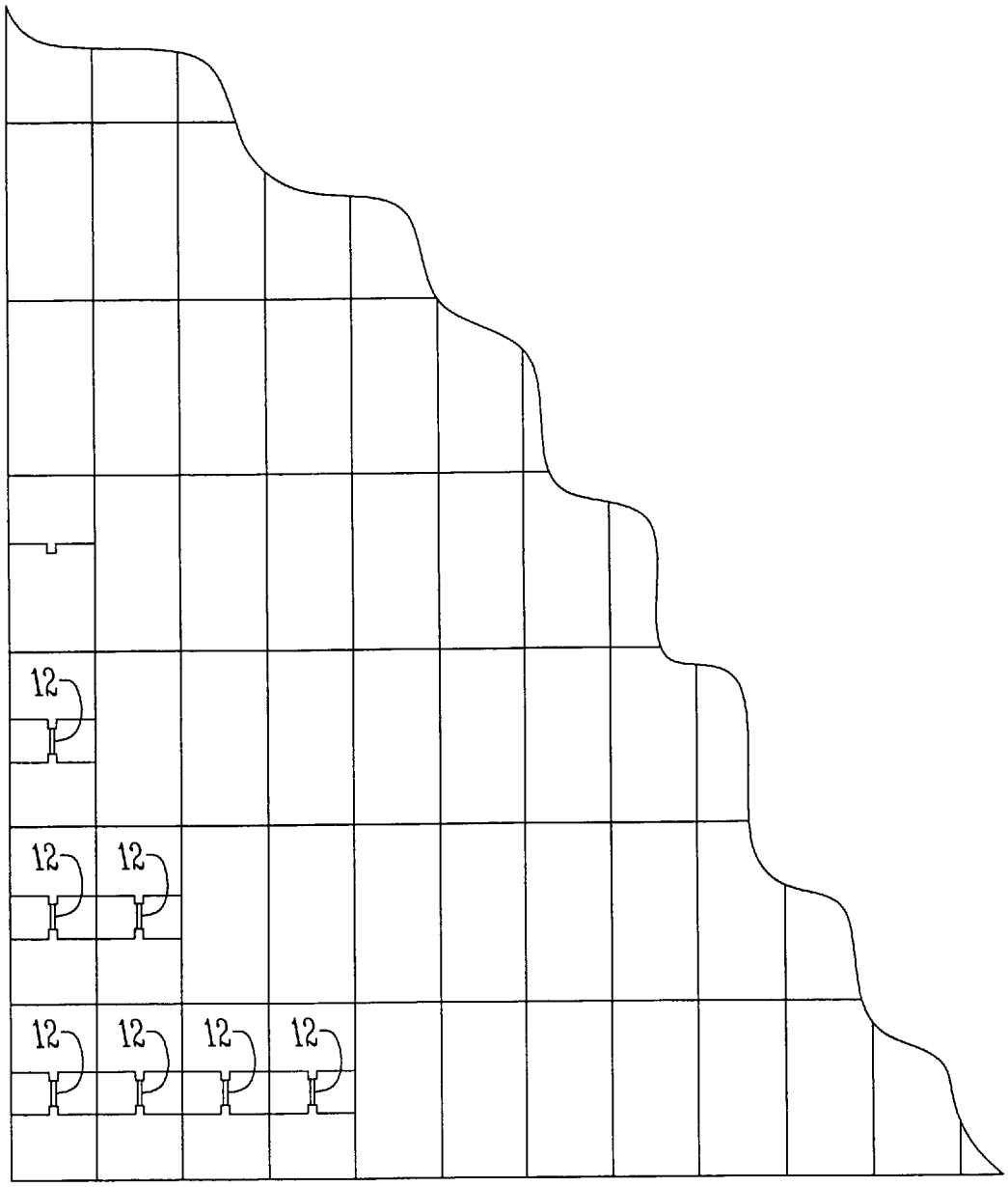
FIG. 9 is a top view of the step and repeat array of resistors.

It is to be appreciated that many such resistors of the present invention may be manufactured at the same time. This is shown best in FIG. 9. In FIG. 9, a step and repeat array of resistors is shown prior to singulation. The resistors can then be singulated for shipping to customers. The KAPTON® (Polyimide) 4 is still a part of the resistor at this point. KAPTON® (Polyimide) 4 provides stability to the foil traces 12. This reduces or eliminates the possibility of foil traces 12 breaking or otherwise being damaged in transit.

Figure 7:
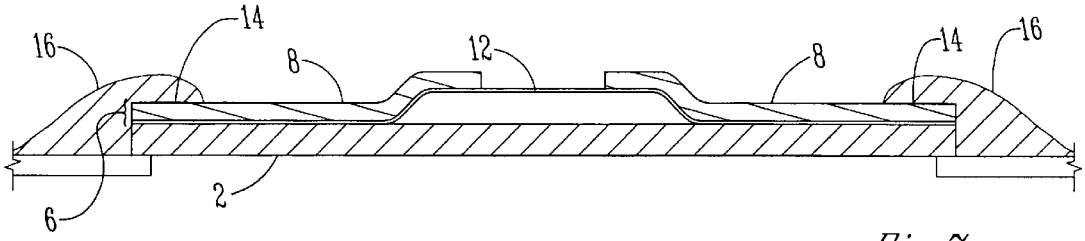
FIG. 7 is a cross-sectional diagram after KAPTON® (Polyimide) has been removed.

Prior to use, KAPTON® (Polyimide) 4 can be dissolved or otherwise removed resulting in the resistor best shown in FIG. 7. This removal may be through application of a chemical solvent. The resistor is then mounted onto the squib and connected to posts. This connection may be made by soldering the resistor in place, applying a conductive epoxy, welding the resistor in place, or other means such as are well known in the art.

In this resistor, foil trace 12 is suspended between the copper terminals on copper plating 8. Thus, when current is passed through the resistor from terminal to terminal, the foil trace 12 will quickly increase in temperature. This increase in temperature is due to the material used for the foil trace 12, the width of the foil trace, and the fact that as the foil trace is not in physical contact with substrate 2, heat is not absorbed by substrate 2.

Figure 8:
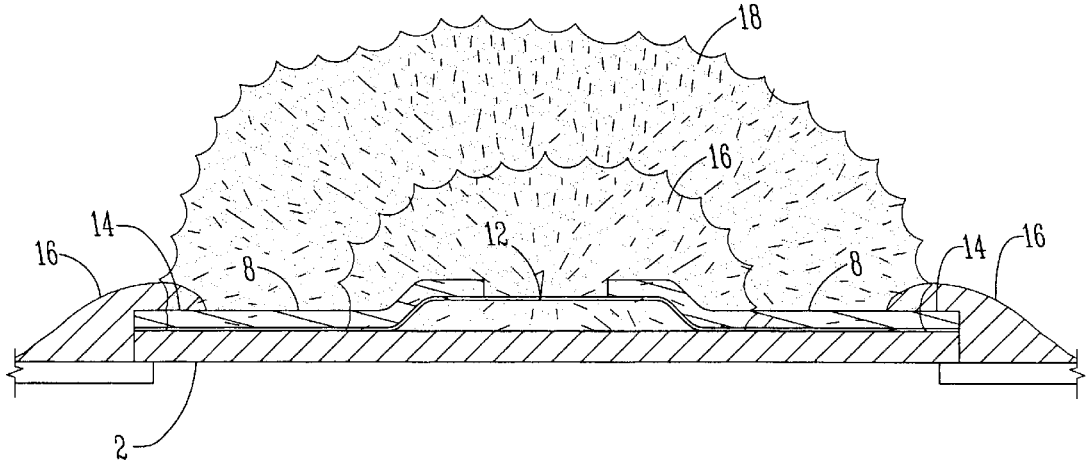
FIG. 8 is a cross-sectional diagram showing the resistor and pyrotechnic.

The customer may include the resistor of the present invention in applications where the resistor serves as an igniter. This is shown beat in FIG. 8 where the resistor is surrounded by a first pyrotechnic material 16 and a second pyrotechnic material 18. Because the foil resistor is suspended, the pyrotechnic material can completely surround the foil resistor. As the foil resistive trace 12 is not attached to a substrate, heat is not absorbed by the substrate due to conduction. As resistor 12 heats, pyrotechnic material 16 is ignited. This results in an explosion which can be used to ignite the second pyrotechnic material 18. One example where this configuration can be used is in an air bag. In an air bag, a current passed through a resistor can be used to ignite a first pyrotechnic 16 which in turn ignites a gas-generating pyrotechnic material 18 which can inflate an air bag. In such application, it is important that the air bag is inflated as quickly as possible thus the fast rising action of resistor 12 is desirable.

Apparatus of The Invention

The apparatus of the present invention is best shown in FIG. 7. The fast heat rise resistor includes a polyimide substrate 2. On top of substrate 2 is KAPTON® (Polyimide) 4. The KAPTON® (Polyimide) is used to secure the resistive trace 12 in place during handling and shipping to a customer. Resistive trace 12 is a foil trace preferably of Ni/Cr, but may be of other types of foil as requirements of the heat rise resistor may require. The foil trace 12 is elevated above the substrate 2 as the foil trace 12 is on top of the KAPTON® (Polyimide) layer 4. The resistor also has a top layer 8 of copper plating on the copper plated foil 6. The underside of the copper plating foil is foil and that portion of the foil that extends across the gap is the resistive trace 12. The resistor is secured on place onto a circuit board or other structure through soldering with solder 16 onto solder patch 14. The present invention contemplates that the resistor may be mounted by other methods such as conductive epoxy or welding.

FIG. 7 best shows the resistor after the layer of KAPTON® (Polyimide) 4 has been removed. When the layer of KAPTON® (Polyimide) 4 is removed, such as by application of a chemical solvent, the foil trace is suspended over substrate 2. This results in the heat of foil 12 increasing more rapidly as current is passed through the resistor. As the foil trace 12 is not in physical contact with substrate 2, heat is not absorbed by the substrate 2 which would increase the time that it would take for a given current passed through the resistor to cause foil trace 12 to reach a particular temperature. The apparatus of the present invention is shown in one environment in FIG. 8. In this environment, the resistor is surrounded by pyrotechnic material 16. Thus, when foil trace 12 reaches a particular temperature, pyrotechnic material 16 is ignited. The ensuing explosion serves to ignite a gas generating pyrotechnic 18. The amount of time that is needed to ignite is reduced because the foil trace 12 is heated more thickly than in the prior art.

Due to the fast rise time and reliability, the present invention contemplates use in a variety of applications, including, without limitation, auto-ignition applications, safety applications, airings, seat belt pretensioners, battery cable disconnects, fuel line shut off devices, roll bars, and numerous other uses.

Thus, an apparatus and method for a fast heat rise resistor using foil work with photolithographic production has been disclosed which solves problems and deficiencies in the art. It will be readily apparent to those skilled in the art that different types of substrates and types of foil may be used in the foil resistor. It will also be clear to those skilled in the art that different materials, dimensions, and other variations may be used including different types of foil, different thicknesses and widths of foil, different thicknesses of plating, different lengths of foil, different films in place of KAPTON® (Polyimide), and other variations as required by particular applications and environments.

It is therefore seen that this invention will achieve at least all of its stated objectives.

What is claimed is:

1. A fast heat rise resistor comprising:

a resistor substrate having a flat surface and an opposite bottom surface;

a resistive foil bridge formed from a plated foil having a conductive layer plating side and an opposite foil side;

the resistive foil bridge on the top surface of the substrate, the resistive foil bridge having an elevated portion and a contact portion, the elevated portion being separated from and elevated above the top surface of the resistor substrate by a void adapted to be at least partially filled with pyrotechnic material to increase contact between the foil bridge and the pyrotechnic material, the contact portion attached to said top surface of the resistor substrate to support said bridge;

a portion of the elevated portion of the resistive foil bridge suspended across the void with the conductive layer plating removed; and a layer of film affixed between the resister substrate and the elevated portion of the foil bridge for partially filling the void and supporting the portion of the elevated portion of the resistive foil bridge suspended over the void.

2. The resistor of claim 1 wherein the foil side comprises Ni/Cr.

3. The resistor of claim 1 wherein the resistor substrate is polyimide.

4. The resistor of claim 1 wherein the film is polyimide film.

5. A fast heat rise resistor comprising:

a resistor substrate;

a resistive foil bridge formed from a plated foil having a conductive layer plating side and an opposite foil side;

the resistive foil bridge on the surface of the substrate, the resistive foil bridge having an elevated portion and a contact portion, the elevated portion being separated from and elevated above the resistor substrate by a void adapted to be at least partially filled with a pyrotechnic material to increase contact between the resistive foil bridge and the pyrotechnic material, the contact portion is attached to said surface of the resistor substrate to support said resistive foil bridge;

a portion of the elevated portion of the resistive foil bridge suspended over the void with the conductive layer plating removed;

opposite resistor terminals electrically connected to the contact portion on opposite ends of the void; and a customer removable layer of material between the resistive substrate and the elevated portion of the foil and partially filling the void to provide additional support for the elevated portion of the resistive foil bridge during handling and shipment.

6. A fast heat rise resistor, comprising:

a resistor substrate having a top surface and opposite bottom surface;

a copper plated foil comprising a layer of copper attached to a foil layer, the copper plated foil having a contact portion attached to the top surface of the resistor substrate and an elevated portion separated from the top surface of the resistor substrate by a void adapted to be at least partially filled with pyrotechnic material;

the elevated portion having the layer of copper partially removed forming a foil trace, the foil trace being suspended over the resistor substrate and across the void;

the foil trace being adapted for contact with pyrotechnic material on all sides to decrease time of ignition of the pyrotechnic material due to increased contact area between the foil trace and the pyrotechnic material and decreased heat loss to the resistor substrate due to conduction.

7. A fast heat rise resistor for use in igniting a pyrotechnic material, comprising:

a resistor substrate having a flat top surface and an opposite bottom surface;

a resistive foil bridge formed from a plated foil having a conductive layer plating side and an opposite foil side;

the resistive foil bridge on the top surface of the substrate, the resistive foil bridge having an elevated portion and a contact portion, the elevated portion being separated from the top surface of the resistor substrate by a void adapted to be at least partially filled with the pyrotechnic material to increase contact between the resistive foil bridge and the pyrotechnic material the contact portion attached to and directly contacting said top surface of the resistor substrate; and a portion of the elevated portion of the resistive foil bridge suspended over the void with the conductive plating removed.

* * * * *